United States Patent [19]

Suzuki et al.

[11] 4,211,839

[45] Jul. 8, 1980

[54] METHOD OF PRODUCING LIGHT-SENSITIVE COMPOSITION FOR USE IN THERMALLY DEVELOPABLE LIGHT-SENSITIVE ELEMENTS AND ELEMENTS SO PRODUCED

[75] Inventors: Nobuo Suzuki, Asaka; Kenji Sashihara, Minami-ashigara; Takao Masuda, Asaka, all of Japan

[73] Assignee: Fuji Photo Film Co., Ltd., Minami-ashigara, Japan

[21] Appl. No.: 875,727

[22] Filed: Feb. 7, 1978

Related U.S. Application Data

[63] Continuation of Ser. No. 791,447, Apr. 27, 1977, abandoned, which is a continuation-in-part of Ser. No. 724,197, Sep. 17, 1976, abandoned.

[30] Foreign Application Priority Data

Sep. 17, 1975 [JP] Japan ..... 50-112452

[51] Int. Cl.[2] ..... G03C 1/02; G03C 5/30

[52] U.S. Cl. ..... 430/619; 430/353

[58] Field of Search ..... 96/114.1, 48 HD, 114.6, 96/66 T, 67, 95, 107

[56] References Cited

U.S. PATENT DOCUMENTS

| | | | |
|---|---|---|---|
| 3,086,863 | 4/1963 | Hunt et al. | 96/108 |
| 3,617,289 | 11/1971 | Ohkubo et al. | 96/114.1 |
| 3,832,186 | 8/1974 | Masuda et al. | 96/114.1 |
| 3,893,860 | 7/1975 | Sutton et al. | 96/114.1 |
| 3,957,493 | 5/1976 | Masuda et al. | 96/114.1 |
| 3,980,482 | 9/1976 | Reece | 96/114.1 |
| 4,065,312 | 12/1977 | Weyde et al. | 96/114.1 |
| 4,128,428 | 12/1978 | Ikenoue et al. | 96/114.1 |

OTHER PUBLICATIONS

C.A. 5900b, Goetze et al., vol. 75, p. 493.

C.A. 1288395, Yao, vol. 76, p. 110.

*Primary Examiner*—J. Travis Brown

*Attorney, Agent, or Firm*—Sughrue, Rothwell, Mion, Zinn and Macpeak

[57] ABSTRACT

In a method of producing a composition for use in thermally developable light-sensitive photographic elements comprising mixing: a composition comprising (a) an organic silver salt and (b) a light-sensitive silver halide, and (c) a reducing agent; the improvement wherein (b) is prepared by allowing a light-sensitive silver halide-yielding component to react with (a) in the presence of (d) an imino compound.

The elements so produced are also described.

12 Claims, No Drawings

METHOD OF PRODUCING LIGHT-SENSITIVE COMPOSITION FOR USE IN THERMALLY DEVELOPABLE LIGHT-SENSITIVE ELEMENTS AND ELEMENTS SO PRODUCED

CROSS REFERENCE TO RELATED APPLICATIONS

This application is a continuation of copending application Ser. No. 791,447, filed Apr. 27, 1977, now abandoned, which is in turn a continuation-in-part application of co-pending application Ser. No. 724,197, filed Sept. 17, 1976, now abandoned.

BACKGROUND OF THE INVENTION

1. Field of the Invention

The present invention relates to a process for producing a thermally developable light-sensitive composition, more particularly, to a process for producing a light-sensitive composition capable of providing a thermally developable light-sensitive element having reduced light discoloration after processing. The present invention also relates to thermally developable light-sensitive composition and elements.

2. Description of the Prior Art

A thermally developable light-sensitive element is known which utilizes a composition essentially comprising the silver salt of an organic acid, a small amount of silver halide, and a reducing agent, as described in U.S. Pat. Nos. 3,125,904 and 3,457,075. In this light-sensitive system, the silver halide that remains after development in the element is not stabilized against light, but allowed to discolor by light. The light-sensitive element is stable at ordinary temperatures, but when it is exposed in an image-wise pattern and heated, usually to above 80° C., preferably above 100° C., the organic silver salt oxidizing agent and the reducing agent contained in the light-sensitive layer undergo an oxidation-reduction reaction due to the catalytic action of the exposed silver halide existing in the vicinity thereof to form silver. By this reaction the exposed areas of the light-sensitive layer are rapidly blackened so that contrast is formed between exposed areas and unexposed areas (background), that is, an image is formed.

It is known that the thus formed image of such a thermally developable light-sensitive element becomes obscure because of undesired discoloration generated after development in unexposed areas (hereinafter referred to as light discoloration).

Among known methods of preventing such light discoloration there is one using a precursor of stabilizers such as azole thioethers and blocked azole thiones, such as described in U.S. Pat. No. 3,839,041; one using tetrazolylthio compounds, such as described in U.S. Pat. No. 3,700,457; and one using a light-sensitive halogen-containing organic oxidizing agent, such as described in U.S. Pat. No. 3,707,377.

It has been found, however, that light discoloration is not greatly decreased by the above methods.

In another method of solving the problem, the element is subjected to blueing by the use of a blue dye such as Victoria Blue, which results in an improvement of its whiteness. This method, however, provides no fundamental solution to the problem since the method simply gives the appearance of reduced discoloration to the element which still essentially undergoes light discoloration.

SUMMARY OF THE INVENTION

It is one object of this invention to provide a method of producing a light-sensitive composition capable of giving a thermally developable light-sensitive element having a reduced light discoloration after development.

It is another object of this invention to provide a method of producing a light-sensitive composition capable of giving a thermally developable light-sensitive element having reduced thermal fog and improved whiteness.

It is yet a further object of this invention to provide a light-sensitive composition and a thermally developable light-sensitive element having reduced light discoloration after development, reduced thermal fog and improved whiteness.

According to this invention, there is provided a method of producing a light-sensitive composition for use in thermally developable light-sensitive elements, comprising mixing (a) an organic silver salt, (b) a composition comprising a light-sensitive silver halide, and (c) a reducing agent, component (b) being a composition prepared by allowing a light-sensitive silver salt-yielding component to react with component (a) in the presence of (d) an imino compound.

The present invention also provides a light-sensitive composition for use in thermally developable light-sensitive elements, and thermally developable light-sensitive elements, which is obtained by mixing (a) an organic silver salt, (b) a composition comprising a light-sensitive silver halide, and (c) a reducing agent, component (b) being prepared by allowing a light-sensitive silver salt-yielding component to react with component (a) in the presence of (d) an imino compound.

DETAILED DESCRIPTION OF THE INVENTION

The organic silver salt ingredient (a) in the present invention is a colorless or slightly colored silver salt comparatively stable against light, which reacts with a reducing agent to form a silver image when heated to not less than about 80° C., preferably not less than 100° C., in the presence of exposed silver halide. Such organic silver salts include silver salts of organic compounds having an imino group, a mercapto group, a thione group or a carboxy group. Specific examples thereof are as follows.

(1) Silver salts of organic compounds having an imino group: silver salt of benzotriazole, silver salt of nitrobenzotriazole, silver salt of an alkyl-substituted benzotriazole (e.g., methylbenzotriazole, etc.), silver salt of a halogen-substituted benzotriazole (e.g., silver salt of bromobenzotriazole, silver salt of chlorobenzotriazole, etc.), silver salt of a carboimido-substituted benzotriazole (e.g.,

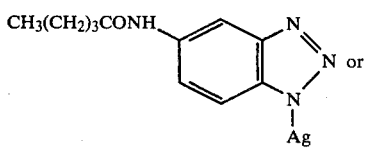

-continued

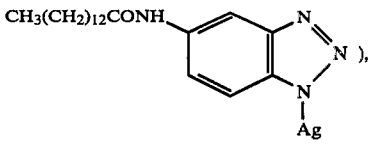

silver salt of benzimidazole, silver salt of a substituted benzimidazole (e.g., silver salt of 5-chlorobenzimidazole, silver salt of 5-nitrobenzimidazole, etc.), silver salt of carbazole, silver salt of saccharin, silver salt of phthalazinone, silver salt of a substituted phthalazinone, silver salts of phthalimides, silver salt of pyrrolidone, silver salt of tetrazole, silver salt of imidazole, N-(benzoic acid-sulfonic acid-(2)-imide) silver, N-(4-nitrobenzoic acid-sulfonic acid-(2)-imide)silver, N-(5-nitrobenzoic acid-sulfonic acid-(2)-imide) and other N-(benzoic acid sulfonic acid-(2)-imide)silvers, etc.

(2) Silver salts of mercapto group- or thione group-containing compounds: silver S-alkyl-tnioglycolates wherein the alkyl substituent has 12 to 22 carbon atoms, as disclosed in Japanese Patent Application (OPI) 28221/73; silver salts of 2-alkylthio-5-(carboxylatemethylthio)-1,3,4-thiodiazoles, most preferably those wherein the alkyl group has from 12 to 22 carbon atoms, or silver salts of 3-(carboxylatemethylthio)-1,2,4-triazoles; silver salts of thione compounds as disclosed in U.S. Pat. No. 3,785,830 (wherein the thione compounds are represented by the following general formula

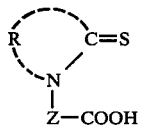

wherein R represents the atomic group necessary to complete a 5-membered heterocyclic ring, such as a thiazoline ring, imidazoline ring, pyrazoline ring, etc., and Z represents an alkylene group containing 1 to 10 carbon atoms.); silver S-2-aminophenylthiosulfate as disclosed in U.S. Pat. No. 3,549,379; 2-mercaptobenzoxazole silver, mercaptoxadiazole silver, 2-mercaptobenzothiazole silver, 2-(S-ethylthioglycolamide)benzothiazole silver, 2-mercaptobenzimidazole silver, 3-mercapto-4-phenyl-1,2,4-triazole silver, silver salts of mercaptotriazines, silver salts of 2-mercapto-5-aminothiadiazoles, silver salts of 1-phenyl-5-mercaptotetrazoles, silver salts of dithiocarbonates such as a silver salt of dithioacetate, thioamide silver, silver salts of thiopyridines such as 5-carbethoxy-1-methyl-2-phenyl-4-thiopyridine silver, dithiodihydroxybenzole silver, silver diethyldithiocarbamates, etc.

(3) Carboxy group-containing organic silver salts: (a) Silver salts of aliphatic carboxylic acids; silver caprate, silver laurate, silver myristate, silver palmitate, silver stearate, silver behenate, silver maleate, silver fumarate, silver tartarate, silver furoinate, silver linolate, silver oleate, silver hydroxystearate, silver adipate, silver sebacate, silver succinate, silver acetate, silver butyrate, silver camphorate, silver undecylenate, silver lignocerate, silver arachidonate, silver erucinate, silver oxalate, silver 10,12,14-octadecatrienoate, silver salts of thioether group containing aliphatic carboxylic acids as disclosed in, for example, U.S. Pat. No. 3,330,663; silver propionate, silver valerate, silver caproate, silver caprylate, silver t-butylhydroperoxide, silver malonate, silver glutarate, silver pimelate, silver azelainate, silver chloroacetate, silver trichloroacetate, silver fluoroacetate, silver iodoacetate, silver sarcosinate, silver aniline acetate, silver mandelate, silver hippurate, silver naphthalene acetate, silver creatinate, silver lactate, silver $\alpha$ or $\beta$-mercaptopropionate, silver levulinate, silver salts of amino acids such as L-alanine, $\gamma$-amino lactic acid, $\epsilon$-aminocapronic acid, L-aspartic acid, L-glutamic acid, L-leucine, etc., silver tricarballylate, silver nitrilotriacetate, silver citrate, silver ethylenediamine tetraacetate, silver acrylate, silver methacrylate, silver crotonate, silver sorbinate, silver itaconate, etc. (b) Silver salts of aromatic carboxylic acids; silver benzoate, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenyl acetate, silver pyromellitate, silver salt of 4'-n-octadecyloxydiphenyl-4-carboxylic acid, silver m-nitrobenzoate, silver o-aminobenzoate, silver furoinate, silver p-hexoxybenzoate, silver octadecoxybenzoate, silver cinnamate, silver p-methoxycinnamate, silver furoate, silver p-nitrophenyl acetate, silver nicotinate, silver isonicotinate, silver picolinate, silver pyridine-2,3-dicarbonate, etc.

(4) Silver sulfonates: silver ethane sulfonate, silver 1-propane sulfonate, silver 1-butane sulfonate, silver 1-pentane sulfonate, silver allyl sulfonate, silver benzene sulfonate, silver 1-n-butylnaphthalene-4-sulfonate, silver naphthalene-1,5-disulfonate, silver $\alpha$- or $\beta$-naphthalene sulfonate, silver p-toluene sulfonate, silver toluene-3,4-disulfonate, silver diphenylamine sulfonate, silver 2-naphthol-3,6-dissulfonate, silver anthraquinone-$\beta$-sulfonate, silver 2-amino-8-naphthol-6-sulfonate, silver p-styrene sulfonate, etc.

(5) Silver sulfinates: silver p-toluene sulfinate, silver p-acetoaminobenzene sulfinate, silver benzene sulfinate, etc.

(6) Silver organic phosphates: silver phenyl phosphate, silver p-nitrophenyl phosphate, silver $\beta$-glycerophosphate, silver 1-naphthyl phosphate, silver adenocine-5'-3-phosphate, etc.

(7) Silver salts of macromolecular compounds: silver polyacrylate, silver polyvinyl hydrogen phthalate, silver polystyrene sulfonate, etc.

(8) Other silver salts: the silver salt of 4-hydroxy-6-methyl-1,3,3a,7-tetrazaindene, the silver salt of 5-methyl-7-hydroxy-1,2,3,4,6-pentazaindene, the silver salts of tetrazaindenes as disclosed in British Pat. No. 1,230,642; metal-containing aminoalcohols as disclosed in British Pat. No. 1,346,595; organic acid chelates of silver as disclosed in U.S. Pat. No. 3,794,496; silver 5-nitrosalicylaldoxime, silver 5-chlorosalicylaldoxime, silver salt of barbituric acid, silver picrate, silver rosinate, silver indophenol, the silver complex of cyclopentadiene, the silver complex of pyridine, the silver complex of cyclopentapolyene, the silver complex of N-vinylcarbazole, silver o-sulfobenzimide, etc.

In addition, oxidizing agents such as titanium oxide, zinc oxide, gold salts of carboxylic acids, e.g., gold laurate, gold stearate, gold behenate, etc., can be optionally employed together with the above described silver salts.

Of the above described organic silver salts, comparatively light stable organic silver salts are suitable when silver halides or light-sensitive complexes of silver and dyes as described in French Pat. No. 2,089,208 are used as photocatalysts. Silver salts of aliphatic carboxylic acids containing 10 to 35 carbon atoms are particularly preferred.

Those organic silver salts may be prepared by methods such as described in U.S. Pat. Nos. 3,457,075, 3,839,049 and 3,458,544, British Pat. Nos. 1,173,426 and 1,405,867, German Patent Applications (OLS) Nos. 2,401,159 and 2,322,096, U.S. Pat. No. 3,700,458, and Japanese Patent Application (OPI) No. 13,224/74. Among these methods, the ones described in British Pat. Nos. 1,173,462 and 1,405,867 are particularly preferred.

The light-sensitive silver salt, component (b), used in the invention may be silver chloride, silver bromide, silver iodide, silver chlorobromoiodide, silver chlorobromide, silver chloroiodide, silver iodobromide, or a mixture thereof.

Component (b) must be prepared by allowing component (a) to react with a light-sensitive silver halide-yielding component in the presence of component (d).

The above described light-sensitive silver halide-yielding component may be any compound capable of reacting with an organic silver salt to yield a silver salt. An effective compound can be found by a simple test, that is, by examining whether the X-ray diffraction pattern of the examined compound exhibits peaks characteristic of a silver halide after it has been allowed to react with an organic silver salt, and, if necessary, heated. If so, it can be used.

As specific examples of ingredients capable of forming a light-sensitive silver halide there are illustrated the following compounds. (1) Inorganic halides: halides represented by, e.g., $MX_n$ (wherein M represents H, $NH_4$ or a metal atom, X represents Cl, Br or I, and n represents 1 when M is H or $NH_4$, or, when M is a metal atom, n represents the valence of the metal, where examples of the metal atom include lithium, sodium, potassium, rubidium, cesium, copper, gold, beryllium, magnesium, calcium, strontium, barium, zinc, cadmium, mercury, aluminum, gellium, indium, lanthanum, ruthenium, thallium, germanium, tin, lead, antimony, bismuth, chromium, molybdenum, tungsten, manganese, rhenium, iron, cobalt, nickel, rhodium, palladium, osmium, iridium, platinum, etc.)

(2) Halogen-containing metal complexes: for example, $K_2PtCl_6$; $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RbCl_6$, $(NH_4)_3RhBr_6$, etc.

(3) Onium halides: quaternary ammonium halides (e.g., trimethylphenylammonium bromide, cetylethyldimethylammonium bromide, trimethylbenzylammonium bromide, etc.), quaternary phosphonium halides (e.g., tetraethylphosphonium bromide, etc.), tertiary sulfonium halides (e.g., trimethylsulfonium iodide, etc.), etc., can be added to a coating dispersion just prior to coating (for example, a coating dispersion for a light-sensitive layer, a protective layer, an undercoating layer or a back coating layer) for the purpose of reducing sensitivity, and, in some cases, background density, as is described in U.S. Pat. No. 3,679,422. Also, as is described in Japanese Patent Publication (OPI) No. 84443/74, a conductive high molecular weight polymer of the onium salt halide series can be used to prepare a thermally developable light-sensitive and electrosensitive material.

(4) Halogenated hydrocarbons: iodoform, bromoform, carbon tetrabromide, 2-bromo-2-methylpropane, etc.

(5) N-halogeno compounds: e.g., compounds which are represented by the following formulae (I) and (II)

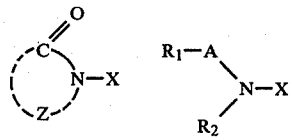

(I) (II)

and N-halides containing an $—SO_2NX—$ group (III)(-where X is Cl or Br), wherein for formulae (I) and (II), X represents Cl, Br or I, Z represents the atomic group necessary to form a 5- to 7-membered ring which may be further condensed with another ring, A represents a carbonyl group and $R_1$ and $R_2$ each represents a hydrogen atom, an alkyl group, an aryl group or an alkoxy group, as are disclosed in detail in British Pat. No. 1,498,956. Specific examples thereof include N-chlorosuccinimide, N-bromosuccinimide, N-bromophthalimide, N-bromoacetoamide, N-iodosuccinimide, N-bromophthalazone, N-bromooxazolinone, N-chlorophthalazone, N-bromoacetoanilide, N,N-dibromobenzene sulfonamide, N-bromo-N-methylbenzene sulfonamide, 1,3-dibromo-4-, 4-dimethylhydantoin, the potassium salt of dibromoisocyanuric acid, trichloroisocyanuric acid, etc., as disclosed in British Pat No. 1,498,956 and U.S. Pat. No. 4,003,479, etc.; N-halogeno compounds of unsubstituted and substituted benzotriazoles the latter of which may be substituted with, for example, an alkyl group, most preferably an alkyl group having from 1 to 5 carbon atoms, a nitro group, a halogen atom, an imido group and an amino group; and N-halogeno compounds of benzimidazoles.

(6) Other halogen-containing compounds: triphenylmethyl chloride, triphenylmethyl bromide, 2-bromobutyric acid, 2-bromoethanol, dichlorobenzophenone, etc.

If desired, the above composition obtained by the addition of a silver halide-yielding component may be ripened by allowing it to stand for an appropriate time (e.g., 20 minutes to 48 hours) at room temperature or at elevated temperature (preferably 30° C. to 80° C.) in the presence of a sulfur-containing compound, such as thiosulfates or the like; a metal, such as gold, chromium, tin, lithium or palladium; a reducing agent; or a mixture thereof.

Similar improvements in photographic characteristics can be achieved by applying a precipitation technique which is often employed in the art of producing gelatino silver halide emulsions wherein silver halide is allowed to form in the presence of a portion of a binder, the resulting silver salt is precipitated by means of a centrifugal separator, and then dispersed again into the remainder of the binder. When redispersion is carried out, the presence of nitric acid, a ferricyanide, thiocyanates, thiosulfates, benzotriazole, tetrazaindenes, mercapto compounds, thione compounds, iodides, heavy metal salts such as a rhodium salt, and the like can also be added to favorably alter photographic characteristics.

In the above processes, two or more of the silver halide-yielding components may be used in combination. Used singly or alone, the silver halide-yielding components can be used in an amount of from about 0.001 to about 0.5 mol, preferably from about 0.01 to about 0.3 mol, per mol of the organic silver salt, component (a). In the above, (5) N-halogeno compounds are most preferred for the present invention. If used in an amount less than the lower limit, insufficient sensitivity is obtained, while if used in an amount greater than the upper limit, light discoloration (undersirable coloring that appears in background areas when a processed thermally developable light-sensitive material is allowed to stand in room light) tends to increase.

In this invention, a part of the organic silver salt, component (a), is converted to light-sensitive silver halide by allowing the organic silver salt to react with the silver halide-yielding component in the presence of an imino compound, component (d). These imino compounds are compounds capable of forming a silver salt (i.e., with an Ag—N< structure) by reaction with component (a). Such silver salts have the ability to change the concentration of the silver ions in the reaction system at the time of silver halide formation.

Examples of imino compounds used in the above step include those represented by the following general formula:

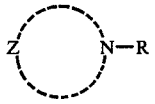

wherein R represents a hydrogen atom, a halogen atom (chlorine, bromine or iodine) a hydroxy group or a sulfonyl group; and Z represents atoms necessary to complete a nucleus selected from the group consisting of pyrazoles, imidazoles, benzimidazoles, triazoles and benzotriazoles, including substituted ones, for example, substituted by an alkyl group, preferably containing 1 to 12 carbon atoms (e.g., methyl, ethyl, propyl, butyl, pentyl, hexyl, octyl, nonyl, decyl, dodecyl, etc.); a substituted alkyl group, preferably containing, in the alkyl group, 1 to 12 carbon atoms and substituted, for example, by an alkoxyl group containing 1 to 4 carbon atoms (e.g., methoxyl, ethoxyl, propoxyl, butoxyl, etc.), an acyl group containing 2 to 4carbon atoms (e.g., acetyl, propionyl, butyryl, etc.), a halogen atom (Cl, Br or I), a hydroxyl group, an amino group, a nitro group, a phenyl group, and the like; an alkoxy group, preferably containing 1 to 8 carbon atoms (e.g., methoxy, ethoxy, propoxy, butoxy, pentyloxy, hexyloxy, heptyloxy, octyloxy, etc.); an acyl group, preferably containing 2 to 8 carbon atoms (e.g., acetyl, propionyl, butyryl, valcryl, hexanoyl, heptanoyl, octanoyl, etc.); an alkylthio group, preferably containing 1 to 12 carbon atoms (e.g., methylthio, ethyltio, propylthio, butylthio, pentylthio, hexylthio, octylthio, decylthio, dodecylthio, etc.); a hydroxyl group; a mercapto group; a halogen atom (Cl, Br or I); a nitro group; a nitroso group; an amino group; a sulfonyl group represented by $—SO_2R'$ (wherein R' represents an alkyl group containing 1 to 12 carbon atoms or an aryl group which may be substituted with an alkyl group containing 1 to 4 carbon atoms, an alkoxy group containing 1 to 4 carbon atoms, a halogen atom (Cl, Br or I), a nitro group, a nitroso group or an amino group); and the like.

Typical and preferred examples of component (d) used in the invention include benzotriazole, 5-methylbenzotriazole, 5-n-octylbenzotriazole, 5-(4-bromo-n-butyl)benzotriazole, 6-chlorobenzotriazole, 1-hydroxybenzotriazole, 5-n-octyloxybenzotriazole, 5,6-dimethylbensotriazole, 6-nitrobenzotriazole, triazole, 4-methyltriazole, 5-chlorotriazole, 4-ethyl-5-methyltriazole, benzimidazole, 2-hydroxybenzimidazole, 1-hydroxybenzimidazole, 2-n-propylthiobenzimidazole, 4-n-butylbenzimidazole, 4-(3-amino-n-propyl-)imidazole, 6-nitrobenzimidazole, imidazole, 2-methylimidazole, 2-hydroxyimidazole, 4-methylimidazole, 4-octyloxyimidazole, 4-methyl-2-hydroxyimidazole, 5-chloroimidazole, 5-methylpyrazole, 3-chloropyrazole, 3,5-dimethylpyrazole, 1-(methanesulfonyl)benzotriazole, 1-(benzenesulfonyl)-benzotriazole, 1-(p-methyl-benzenesulfonyl)benzotriazole, 1-(p-nitro-benzenesulfonyl)benzotriazole, and the like. All of these compounds are known and commercially available.

Among these imino compounds, benzimidazoles are particularly preferred.

In preparing the composition containing components (a), (b) and (c) in accordance with this invention, component (a) is prepared at first, and then the light-sensitive silver halide-yielding component is allowed to react with the above prepared component (a) in order to provide component (b). Thereafter, component (c) is added to the resulting mixture. Accordingly, the above described component (d) is added to component (a) after its preparation but before the preparation of component (b), preferably before the mixing of the light-sensitive silver halide-yielding component with component (a).

The objects of this invention cannot be attained when component (d) is added after the preparation of component (b), or when component (b) is prepared by adding the silver halide-yielding component into a composition prepared by incorporating component (d) into a mixture of components (a) and (c). In the most preferred embodiment of this invention, component (d) is added about 10 to about 60 minutes before the addition of the silver halide-yielding component.

In the most preferred embodiment of this invention, component (a) is used in a polymer dispersion. Examples of such polymers are polyvinyl butyral, polyvinyl acetate, ethyl cellulose, polymethyl methacrylate, cellulose butyrate and polyvinyl alcohol (the polymerization degree thereof is preferably about 100 to about 1,500). The quantity of polymer used is such that ratio, by weight, of polymer to component (a) can vary from about 10 to about 1 to about 1 to about 10, most preferably from 4 to 1 to 1 to 4.

In the above, suitable liquids for forming the dispersion are alcohols having 1 to 5 carbon atoms (e.g., ethanol, isopropanol), water, ketones having 3 to 10 carbon atoms (e.g., acetone, methyl ethyl ketone), aromatic hydrocarbons having 6 to 10 carbon atoms (e.g., benzene, toluene, xylene), carboxylic esters having 3 to 10 carbon atoms (e.g., methyl acetate, ethyl acetate, isoamyl acetate), and the like.

Such a liquid (or liquids) is, in general, used in the range of from about 2.5 to about 100 parts by weight based on 1 part by weight of the polymer, preferably from about 5 to about 20 parts by weight, same basis. Further, in accordance with the present invention, component (a) may be used in a dispersion of the liquid described above instead of a polymer dispersion.

In the present invention, component (a) is firstly mixed with component (d). Component (d) can be added in the solid state into a polymer dispersion of component (a) or a dispersion of component (a) in the liquid(s), but preferably is dissolved or dispersed in a solvent prior to being added thereto. Suitable solvents for component (d) include alcohols, ketones and carboxylic esters as defined for the liquid, and water. In general, component (d) is dissolved in such a solvent in a concentration of about $10^{-4}$ to about $10^{-1}$ wt%. The amount of component (d) added is preferably from about $1\times10^{-6}$ to about $6\times10^{31\ 3}$ mol, more preferably from about $6\times10^{-5}$ to about $2\times10^{-3}$ mol, per mol of component (a).

It is preferred that component (a) be mixed with component (d) at room temperature to 80° C. at atmospheric pressure with stirring.

After mixing, the mixture is most preferably allowed to stand for 10 to 60 minutes and a silver halide-yielding component is added thereto to permit component (a) to react with the silver halide-yielding component, whereby a part of component (a), in general, 0.001 to 0.5 mol, preferably 0.01 to 0.3 mol, per mol of component (a), is converted to a light-sensitive silver halide.

The silver halide-yielding component may be added in solid form to the mixture of components (a) and (b), but preferably is added to the mixture as dispersion or solution in a liquid such as water, alcohols, ketones or carboxylic esters as defined for the liquids disclosed above, in a concentration of about $10^{-2}$ to 10 wt%.

It is particularly preferred that an alcohol be present when an N-halogeno compound is used as a silver halide-yielding component. In this case, the alcohol is present as a solvent for either the solution or dispersion of components (a), (b) or the silver halide-yielding component. Needless to say, the alcohol may be added to the system separately. The alcohol is desirably present in an amount greater than 0.1 mol, preferably greater than 1 mol, per mol of the N-halogeno compound.

The reaction of component (a) and silver halide-yielding component is carried out at temperature of from room temperature to 80° C., preferably 35° to 80° C., for 10 minutes to 48 hours, preferably 20 minutes to 10 hours, at atmospheric pressure, while stirring.

Apart from the mechanism of the improvement in photographic properties attained by the incorporation of component (d) of this invention, the thermally developable light-sensitive element using the light-sensitive composition prepared by the process of this invention surprisingly exhibits markedly reduced light discoloration after processing, and highly improved whiteness.

The light-sensitive silver halide, component (b), may be chemically sensitized, for example, by using chemical sensitizers, such as sulfur compounds, selenium compounds, tellurium compounds, gold compounds, platinum compounds, palladium compounds, etc.; or reducing agents, such as silver, silver stannate, polyamines, sulfinates, etc.; as well as mixtures thereof. As to more details on chemical sensitization, see, for example, U.S. Pat. Nos. 1,623,499, 2,399,083 and 3,297,447, and Japanese Patent Applications (OPI) Nos. 41519/76 and 49023/76. The light-sensitive silver halide emulsion of this invention may preferably be stabilized against the formation of fog by the incorporation therein of stabilizers or anti-foggants, such as thiazolium salts, azaindenes, salts of uranium, rhodium, cadmium, lead and mercury, urazoles, sulfocatechols, oximes, nitrons, nitroindazoles, polyvalent metal salts, platinum compounds, palladium compounds, gold compounds, heterocyclic mercapto compounds, and the like. As to more details on these additives, see, for example, U.S. Pat. Nos. 2,728,663, 2,839,405, 2,566,263 and 2,597,915, and British Pat. Nos. 623,448 and 919,061.

Some known optical sensitizers which are effective for sensitizing gelatino silver halide emulsions can also be effectively used for the sensitization of the thermally developable light-sensitive element of the invention. As examples of effective optical sensitizers, mention may be made of cyanines, merocyanines, rhodacyanines, complex (trinuclear or tetranuclear) cyanines, holopolar cyanines, styryls, hemicyanines, oxonols, hemioxonols, xanthenes, and the like. Among the cyanine dyes, those containing basic nuclei such as thiazolines, oxazolines, pyrrolines, pyridines, oxazoles, thiazoles, selenazoles, imidazoles, etc., are particularly preferred. Such nuclei may contain alkyl groups, alkylene groups, hydroxyalkyl groups, sulfoalkyl groups, carboxyalkyl groups, aminoalkyl groups, or enamine groups capable of forming fused carbocyclic or heterocyclic groups. The dyes may be either symmetrical or unsymmetrical, and can contain alkyl groups, phenyl groups, enamine groups or heterocyclic substituents on a methine or polymethine chain thereof. In particular, cyanine dyes containing carboxyl groups are effective for the sensitization of the elements of this invention. The merocyanine dyes may contain, in addition to the basic nuclei described above, acid nuclei such as thiohydantoins, rhodanines, oxazolidinediones, thiazolidinediones, barbituric nuclei, thiazolinones, malonitriles, pyrazolones, and the like. These acid nuclei may be substituted by alkyl groups, alkylene groups, carboxyalkyl groups, sulfoalkyl groups, hydroxyalkyl groups, alkoxyalkyl groups, alkylamine groups, or heterocyclic nuclei. Merocyanine dyes containing imino or carboxyl groups are particularly effective for the sensitization.

If desired, combinations of these dyes may also be used. In addition, supersensitizing additives which do not absorb visible light may be used simultaneously therewith, such as ascorbic acid derivatives, azaindenes, cadmium salts, organic sulfonic acids, etc., such as those described, for example, in U.S. Pat. Nos. 2,933,390 and 2,937,089. As examples of sensitizing dyes that are particularly effective for the thermally developable light-sensitive elements of this invention, mention may be made of merocyanine dyes containing rhodanine, thiohydantoin, or 2-thio-2,4-oxazolidinedione nuclei, such as those described in U.S. Pat. No. 3,761,279.

These dyes may be used in an amount of from about $1\times10^{-4}$ mol to about 1 mol per mol of component (b) or the silver halide-yielding component.

Ingredient (c), the reducing agent, used in the present invention is one which can reduce the organic silver salt (ingredient (a)) upon being heated in the presence of exposed silver halide. Of such reducing agents, the one actually used is decided depending upon the kind and property of the organic silver salt used.

Specific examples of the reducing agent are as follows.

(1) Substituted phenols: aminophenols; e.g., 2,4-diaminophenol, methylaminophenol, p-aminophenol, o-aminophenol, 2-methoxy-4-aminophenol, 2-$\beta$-hydroxyethyl-4-aminophenol, 4-amino-2,6-dibromophenol, 4-amino-2-methylphenol sulfate, 4-amino-3-methylphenol sulfate, 4-amino-2,6-diiodophenol, 4-amino-2,6-dichlorophenol hydrochloride, N-methyl-p-aminophenol sulfate, 4-benzylideneaminophenol, 4-isopropylideneaminophenol, 4-isopropylideneaminophenol, 2,4-diamino-6-methylphenol, 4-acylaminophenol which contains an acyl group having 2 to 18 carbon atoms, N-(4-hydroxyphenyl)-aminoacetic acid, 4-hydroxyphenyl carbamic acid ethyl ester, 6-dimethylamino-3-hydroxytoluene, N-(4-hydroxyphenyl)-N'-alkyl urea which contains an alkyl group having 1 to 18 carbon atoms, N-(4-hydroxy-3,5-di-t-butylphenyl)-N'-octadecyl urea, N-(4-hydroxy-3,5-dichlorophenyl)-N'-octadecyl urea, 3-chloro-4-hydroxydiphenylamine, 4-(4-hydroxybenzylideneamino)-2-methylphenol, 4-(4-hydroxybenzylideneamino)-3-methylphenol, 4-(3-hydroxybenzylideneamino)phenol, α,α'-bis-(4-hydroxyphenylamino)-p-xylene, 4-benzylidene-amino-2-methylphenol, 4-(2-hydroxybenzylideneamino)-phenol, α,α'-bis(4-hydroxy-3-methylphenylimino)-p-xylene, 2-acylaminophenol which contains an acyl group having 1 to 18 carbon atoms, N-(2-hydroxyphenyl)-N'-alkyl urea which contains an alkyl group having 1 to 18 carbon atoms, 6-aminophenol sulfonic acid-(3)-amide, 6-aminophenol sulfonic acid-(3)-dimethylamide, 2-aminophenol sulfonic acid-(4)-amide, 2-benzylideneaminophenol, 4-(4-hydroxybenzylideneamino)phenol, α,α'-bis-(2-hydroxyphenylamino)-p-xylene, 3-(2-hydroxyphenyl-hydrazono)-2-oxo-oxolane, 3-(4-hydroxyphenylhydrazono)-2-oxo-oxolane, 4-hydroxyanilinomethane sulfonic acid, 4-hydroxy-3-methylanilinomethane sulfonic acid, etc.; alkyl substituted phenols, e.g., p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol, p-octylphenol, 2,4,6-tri-t-butylphenol, 2,6-di-t-butyl-4-octylphenol, 2,6-di-t-butyl-4-ethylphenol, 2,4,6-tri-t-amylphenol, 2,6-di-t-butylphenol, 2-isopropyl-p-cresol, 3-methyl-3-(3-methyl-4-hydroxyphenyl)pentane, 2,6-di-t-butyl-4-nonylphenol, 2,4-di-t-butyl-6-nonylphenol, etc.; aryl substituted phenols, e.g., p-phenylphenol, o-phenylphenol, α-phenyl-o-cresol, etc.; other phenols, e.g., p-acetophenol, p-acetoacetylphenol, 1,4-dimethoxybenzene, 2,6-dimethoxyphenol, chlorothymol, 3,5-di-t-butyl-4-hydroxybenzyldimethylamine, 2,6-dicyclohexyl-p-cresol, 2,6-di-t-butyl-4-methoxymethylphenol, 4-methoxyphenol, 2-methyl-4-methylmercaptophenol, 2,6-dicyclopentyl-p-cresol, 2-t-butyl-6-cyclopentyl-p-cresol, 2-t-butyl-6-cyclohexyl-p-cresol, 2,5-dicyclopentyl-p-cresol, 2,5-dicyclohexyl-p-cresol, 2-cyclopentyl-4-t-butylphenol, 3,5-di-t-butyl-4-hydroxybenzophenone, 3,5-di-t-butyl-4-hydroxy cinnamic acid, 3,5-di-t-butyl-4-hydroxybenzaldehyde, 3,5-di-t-butyl-4-hydroxy cinnamic acid ethyl ester and sulfonamide phenols as disclosed in U.S. Pat. No. 3,801,321; polyvinyl(2-hydroxy-3-methoxybenzal); hydroxyindanes as disclosed in German Patent Application (OLS) No. 2,319,080; hydroxycumarones and hydroxycumaranes as disclosed in U.S. Pat. No. 3,819,382; and novolak resin reaction products prepared from formaldehyde and phenol derivatives (e.g., 4-methoxyphenol, m-cresol, o- or p-t-butylphenol, 2,6-di-t-butylphenol and mixtures thereof).

(2) Substituted or unsubstituted bis, tris and tetrakisphenols: o-bisphenols [e.g., 1,1-bis-(2-hydroxy-3,5-dimethylphenyl)-3,5,5-trimethylhexane, bis(2-hydroxy-3-t-butyl-5-methylphenyl)methane, bis(2-hydroxy-3,5-di-t-butylphenyl)-methane, bis(2-hydroxy-3-t-butyl-5-ethylphenyl)methane, 2,6-methylenebis(2-hydroxy-3-t-butyl-5-methylphenyl)-4-methylphenol, 1,1-bis(5-chloro-2-hydroxyphenyl)methane, 2,2'-methylenebis[4-methyl-6-(1-methylcyclohexyl)phenol], 1,1-bis-(2-hydroxy-3,5-dimethylphenyl)-2-methylpropane, 1,1,5,5-tetrakis-(2-hydroxy-3,5-dimethylphenyl)-2,4-ethylpentane, 3,3',5,5'-tetramethyl-6,6'-dihydroxy-triphenylmethane, 1,1-bis(2-hydroxy-3,5-di-t-butylphenyl)-pentane, 1,1-bis(2-hydroxy-3,5-di-t-butylphenyl)-ethane, 1,1-bis(2-hydroxy-3,5-di-t-butylphenyl)-propane, 1,1-bis(2-hydroxy-3,5-di-t-butylphenyl)butane and 1,1-bis(2-hydroxy-3,5-di-t-amylphenyl)ethane)-1,1-bis(2-hydroxy-3-cyclohexyl-5-t-butylphenyl)methane, 1,1-bis(2-hydroxy-3-cyclopentyl-5-t-butylphenyl)-2,2-dimethylethane, bis(2-hydroxy-3-cyclopentyl-5-methyl-6-cyclopentylphenyl)sulfide, 1,1-bis(2-hydroxy-3-cyclopentyl-5-t-butylphenyl)butane, 1,1-bis(2-hydroxy-3-cyclopentyl-5-t-butylphenyl)methane, 1,1-bis(2-hydroxy-3,5-di-cyclopentyl-6-methylphenyl)methane, 1,1-bis(2-hydroxy-3,6-di-cyclopentyl-5-methylphenyl)methane, bis(2-hydroxy-3-cyclopentyl-5-t-butylphenyl)sulfide, bis(2-hydroxy-3-cyclohexyl-5-t-butylphenyl) sulfide, 1,1-bis(2-hydroxy-3-t-butylphenyl)methane, p-cresol-acetoaldehyde or formaldehyde-novolak resins, bis(2-hydroxy-3-t-butyl-5-methylphenyl) sulfide, 1,1-bis(2-hydroxy-3,5-dimethylphenyl)methane, 1,1-bis(2-hydroxy-3,5-di-t-butylphenyl)-2-methylpropane, 1,2-bis(2-hydroxy-3-t-butyldibenzofuryl)ethane, and 3,3',5,5'-tetra-t-butyl-6,6'-dihydroxytriphenylmethane]; p-bisphenols (e.g., bisphenol A, 4,4'-methylenebis(3-methyl-5-t-butylphenol), 4,4'-methylenebis(2,6-di-t-butylphenol), 3,3', 5,5'-tetra-t-butyl-4,4'-dihydroxybiphenyl, 4,4'-dihydroxybiphenyl, 1,1-bis(4-hydroxyphenyl)cyclohexane, 2,2-bis(3,5-dibromo-4-hydroxyphenyl)propane, 2,2-bis(3,5-dichloro-4-hydroxyphenyl)propane, 2,2-bis(3,5-dimethyl-4-hydroxyphenyl)propane, 2,2-bis(3-methyl-4-hydroxyphenyl)propane, bis(3-methyl-4-hydroxy-5-t-butylphenyl)sulfide, 2,2-bis(4-hydroxy-3,5-di-t-butylphenylthio)propane, 4,4'-butylidenebis(6-t-butyl-3-methylphenol), 4,4'-thiobis-(6-t-butyl-3-methylphenol), 4,4'-thiobis(6-t-butyl-2-methylphenol), 4,4'-butylidenebis(6-methylphenol), 4,4'-benzylidene-bis (2-t-butylphenol), 4,4'-ethylidenebis (6-t-butyl-o-cresol), 4,4'-ethylidenebis (2-t-amylphenol), 4,4'-(p-chlorobenzylidene)-di-(2,6-xylenol), 4,4'-ethylidenebis (2-cyclohexylphenol), 4,4'-pentylidene-di-(o-cresol), 4,4'-(p-bromo-benzylidene)-di-phenol, 4,4'-propylidene-bis (2-phenylphenol), 4,4'-ethylidene-di-(2,6-xylenol), 4,4'-heptylidene-di-(o-cresol), 4,4'-ethylidene-bis (2,6-di-t-butylphenol), 4,4'-(2-butenylidene)-di-(2,6-xylenol), 4,4'-(p-methylbenzylidene)di-(o-cresol), 2,2-bis(3-methyl-4-hydroxy-5-t-butylphenyl)propane, α,α'-(4-hydroxy-3,5-di-t-butylphenyl)dimethyl ether, 4,4'-dihydroxy-3,3', 5,5'-tetra-t-butyl-biphenyl, 4,4'-dihydroxy-3,3'-dimethylbiphenyl, 2,2-bis(3-methyl-4-hydroxy-5-t-butylphenyl)propane, 2,2-bis-(4-hydroxy-3,5-di-t-butylphenyl)propane, 2,2-bis(4-hydroxy-3,5-diethylphenyl)-propane, 2,2-bis(4-hydroxy-3-methyl-5-t-amylphenyl)-propane, 2,2-bis(4-hydroxy-3,5-di-t-amylphenyl)propane, polyphenols (e.g., 2,4,6-tris(3,5-di-t-butyl-4-hydroxybenzyl)phenol, N,N'-di(4-hydroxyphenyl)urea, tetrakis[methylene-(3,5-di-t-butyl-4-hydroxyhydrocinnamato)methane, etc.], diethylstilbestrol, hexestrol, bis(3,5-di-t-butyl-4-hydroxybenzyl)ether, 2,6-bis(2'-hydroxy-3',t-butyl-5'-methylbenzyl)-4-methylphenol, etc.

(3) Substituted or unsubstituted mono- or bis-naphthols and di- or polyhydroxynaphthalenes: bis-β-naphthols (e.g., 2,2'-dihydroxy-1, 1'-binaphthyl, 6,6'-dibromo-2,2'-dihydroxy-1,1'-binaphthyl, 6,6'-dinitro- 2,2'-dihydroxy-1,1'-binaphthyl, bis(2-hydroxy-1-naphthyl)methane, 4,4'-dimethoxy-1,1'-dihydroxy-2,2'-binaphthyl, etc.), naphthols (e.g., α-naphthol, β-naphthol, 1-hydroxy-4-amino-naphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, 1-amino-2-naphthol-6-sodium-sulfonate, 1-naphthylamine-7-sulfonic acid, etc.), 2,3-dihydroxynaphthalene, 1-hydroxy-2-carboxynaphthalene, 1-hydroxy-4-methoxy-dihydronaphthalene, 2-hydroxy-3-carboxynaphthalene, 1-hydroxy-4-ethoxynaphthalene, 1-hydroxy-4-propoxynaphthalene, 1-hydroxy-4-isopropoxynaphthalene, 1-hydroxy-5-methoxynaphthalene, morpholine-(1-hydroxy-4-methoxynaphthyl-(2))-methane, sulfonamide naphthols as disclosed in U.S. Pat. No. 3,801,321; 2-hydroxy-3-aminonaphthalene and 1-hydroxy-5-acylaminonaphthalene which contains an acyl group having 1 to 18 carbon atoms; etc.

(4) Di- or poly-hydroxybenzenes and hydroxymonoethers: hydroquinone, alkyl substituted hydroquinones (most preferably an alkyl group having 1 to 5 carbon atoms, e.g., methylhydroquinone, t-butylhydroquinone, 2,5-dimethylhydroquinone, 2,6-dimethylhydroquinone, t-octylhydroquinone, etc.), halogen substituted hydroquinones (e.g., chlorohydroquinone, dichlorohydroquinone, bromohydroquinone, etc.), alkoxy substituted hydroquinones (most preferably an alkoxy group having 1 to 5 carbon atoms, e.g., methoxyhydroquinone, ethoxyhydroquinone), other substituted hydroquinones (e.g., phenylhydroquinone, etc.), hydroquinone monosulfate, 2,5-dihydroxyalkyl ($C_1$ to $C_{18}$ alkyl moieties are preferred) hydroquinone, 2-ethoxycarbonylhydroquinone, acetylhydroquinone, 2-cyclohexylhydroquinone, (2,5-dihydroxyphenyl)-5-(1-phenyltetrazolyl)sulfide, (6-methyl-2,5-dihydroxyphenyl)-5-(phenyltetrazolyl)sulfide, (2,5-dihydroxyphenyl)-2-(benzothiazolyl)sulfide, 2-dodecyl-5-(5-carboxypentyl)hydroquinone, 2-dodecyl-5-(9-carboxynonyl) hydroquinone, 2-tetradecyl-5-(5-carboxypentyl)-hydroquinone, 2-tetradecyl-5-(9-carboxynonyl)hydroquinone, etc.; hydroquinone monoethers (e.g., p-methoxyphenol- or p-ethoxyhenol-hydroquinone monobenzyl ether, 2-t-butyl-4-methoxyphenol- or 2,5-di-t-butyl-4-methoxyphenol-hydroquinone mono-n-propyl ether, hydroquinone mono-n-hexyl ether; and others, e.g., catechol, 4-phenylcatechol, 3-(dihexylaminomethyl)-5-phenylcatechol, 3-(di-n-hexylaminomethyl)-5-phenylcatechol, 3-cyclohexylpyrocatechol, 4-cyclohexylpyrocatechol, 4-(α-methylbenzyl)pyrocatechol, dicyclohexylpyrocatechol, 5-(N,N-dihexylaminomethyl)-4-phenylcatechol, 4-lauroylcatechol, t-butylcatechol, pyrogallol, azeloyl pyrogallol, 4-stearoyl pyrogallol, di-t-butylpyrogallol, butyryl pyrogallol, 4-azeloyl bipyrogallol, phloroglucinol, resorcinol, 4,6-di-t-butylresorcinol, 4-alkyl resorcinol which contains an alkyl group having 1 to 18 carbon atoms, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, 2,3-dihydroxybenzoic acid, 3,4-dihydroxybenzoic acid, 2,5-dihydroxybenzoic acid, o-aminobenzoic acid, m-aminobenzoic acid, p-aminobenzoic acid, protocatechuic aldehyde, ethyl protocatechuate, cetyl protocatechuate, 4-(3',4'-dihydroxyphenylazo)benzoic acid, 3,4-dihydroxyphenylacetic acid, 1-acetyl-2,3,4-trihydroxybenzene, 2,2'-methylenebis(3,4,5-trihydroxyphenyl)benzoic acid, gallic acid, methyl gallate, propyl gallate, butyl gallate, sodium gallate, ammonium gallate, dodecyl gallate, ethyl gallate, isopropyl gallate, gallic anilide, 3,4,5-trihydroxyacetophenone, etc.; etc.

(5) Ascorbic acid and derivatives thereof: 1-ascorbic acid, isoascorbic acid, ascorbic acid monoesters (e.g., the monolaurate, monomyristate, monopalmitate, monostearate, monobehenate, monobenzoate, 6-palmitate-5-β-carboxypropionate-6, etc., of ascorbic acid), diesters of ascrobic acid (e.g., the dilaurate, dimyristate, dipalmitate, distearate, etc., of ascorbic acid). As the ascorbic acids, those described in U.S. Pat. No. 3,337,342 can also be used.

(6) 3-Pyrazolidones, pyrazolines and pyrazolones: 1-phenyl-3-pyrazolidone, 4-methyl-4-hydroxymethyl-1-phenyl-3-pyrazolidone, those described in British Pat. No. 930,572, 1-(2-quinolyl)-3-methyl-5-pyrazolone, etc.

(7) Reducing sugars: glucose, lactose, etc.

(8) Phenylenediamines: e.g., o-phenylenediamine, p-phenylenediamine, N,N'-dimethyl-p-phenylenediamine, N,N'-diethyl-p-phenylenediamine, N-phenyl-N'-isopropyl-p-phenylenediamine, N,N'-dibenzylidene-p-phenylenediamine, N,N-diethyl-N'-sulfomethyl-p-phenylenediamine, N-benzylidene-N',N'-diethyl-p-phenylenediamine, N,N-dimethyl-N'-sulfomethyl-p-phenylenediamine, 3-methoxy-4-sulfomethylamino-N,N-diethylaniline, N,N'-di-sulfomethyl-p-phenylenediamine, N-(2-hydroxybenzylidene)-N',N'-diethyl-p-phenylenediamine, N-(3-hydroxybenzylidene)-N',N'-diethyl-p-phenylenediamine, N-(4-hydroxybenzylidene)-N',N'-diethyl-p-phenylenediamine, N,N-diethyl-3-methyl-p-phenylenediamine, N,N-diethyl-p-phenyleneamine trifluoroacetate, hydroxyethylparamine and the like, which can provide color images by using them together with phenolic or active methylenic color couplers as disclosed in U.S. Pat. Nos. 3,531,286 and 3,764,328; and can also provide color images in accordance with the method as disclosed in U.S. Pat. No. 3,761,270.

(9) Hydroxyamines: e.g., hydroxyamines as disclosed in U.S. Pat. No. 3,667,958 and Japanese Patent Application (OPI) 28,221/73, etc.

(10) Reductones: e.g., aminohexose reductones, anhydroaminohexose reductions and anhydrodihydroaminohexose reductones, as disclosed in U.S. Pat. No. 3,679,426; linear amino reductones as disclosed in Belgian Pat. No. 786,086; etc.

(11) Hydroxaminic acids: e.g., hydroxaminic acids as disclosed in U.S. Pat. Nos. 3,751,252 and 3,751,255; etc.

(12) Hydrazides: e.g., hydroxy substituted fatty acid arylhydrazides as disclosed in U.S. Pat. No. 3,782,949; etc.

(13) Others: e.g., indane-1,3-diones, each of which contains at least one hydrogen atom at the 2-position as disclosed in U.S. Pat. No. 3,773,512; aminodoximes as disclosed in U.S. Pat. No. 3,794,488; substituted hydropyridines as disclosed in German Patent Application (OLS) No. 2,308,766; organic hydrazone compounds as disclosed in U.S. Pat. No. 3,615,533; hydrazines as disclosed in U.S. Pat. No. 3,667,958; amino-9,10-dihydroacridines; 1,4-dihydropyridines as disclosed in U.S. Pat. No. 3,839,048; acetoacetonitriles; homogentisic acid and homogentiso amides; hydroxytetronic acids and hydroxytetronimide; kojic acid; hinokitiol; p-oxyphenylglycine; 4,4'-diaminodiphenyl; 4,4'-dimethylaminodiphenyl; 4,4', 4''-diethylaminotriphenylmethane; spiroindane; and 4-methylesculetine.

Of the above described reducing agents, phenols which contain an alkyl group, e.g., a methyl, ethyl, propyl, isopropyl or butyl group, or an acyl group at at least one position adjacent to the position having a hydroxyl substituent in an aromatic nucleus, for example, 2,6-di-t-butylphenol group containing mono-, bis-, tris- or tetrakis-phenols, have the characteristic of only a slight color change under light exposure because they are stable to light.

The combined used of these phenolic reducing agents and silver salts of fatty acids particularly exerts a desirable effect, as disclosed in, for example, German Patent Application (OLS) No. 2,321,328.

Moreover, as disclosed in U.S. Pat. No. 3,827,889, reducing agents capable of being deactivated by light exposure, such as photolytic reducing agents, are well suited for use in the present invention because a reducing agent of this kind will be deactivated or decomposed by light when a photographic material containing such a reducing agent is allowed to stand in a bright room after development, resulting in a cessation of reduction, and, therefore, a cessation of color changes. Specific examples of photolytic reducing agents include ascorbic acid and the derivatives thereof, furoin, benzoin, dihydroxyacetone, glycerin aldehyde, rhodisonic tetrahydroxyquinone, 4-methoxy-1-naphthol and so on. As disclosed in U.S. Pat. Nos. 3,827,889 and 3,756,829, a direct positive image can be produced by using such a photolytic reducing agent in the case of making heat developable light sensitive materials and exposing them to light in an image-wise fashion in order to decompose the reducing agent. Further, compounds capable of accelerating the photolysis of the reducing agent can additionally be employed, if desired.

The most preferred reducing agents are 2,4-dialkyl substituted orthobisphenols, 2,6-dialkyl substituted parabisphenols or mixtures thereof. For example, reducing agents represented by the following general formulae are very preferred for use in the present invention:

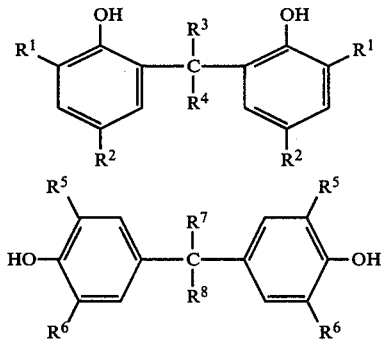

wherein $R^1$, $R^2$, $R^5$ and $R^6$ each represents an alkyl group containing one to five carbon atoms, a cyclopentyl group or a cyclohexyl group, and $R^3$, $R^4$, $R^7$ and $R^8$ each represents a hydrogen atom, an alkyl group containing one to eight carbon atoms, an aryl group (e.g., a phenyl group, a naphthyl group, etc.), a substituted aryl group (e.g., a carboxyphenyl group, a halogen substituted phenyl group, an alkoxy substituted phenyl group, a nitro substituted phenyl group, etc., as are disclosed in detail in German Patent Application (OLS) No. 2,321,328, or an aralkyl group (e.g., a benzyl group, $\beta$-phenylethyl group, etc.).

Suitable reducing agents are selected depending upon the kind (property) of the organic silver salt(s) used (ingredient (a)). For example, a stronger reducing agent is suitable for silver salts which are comparatively difficult to reduce such as the silver salt of benzotriazole, silver behenate, etc., whereas weaker ones are suitable for silver salts which are comparatively easy to reduce such as silver caprate, silver laurate, etc. As the reducing agent for the silver salt of benzotriazole, there are 1-phenyl-3-pyrazolidones, ascorbic acid, ascorbic acid monocarboxylic acid esters, naphthols (e.g., 4-methoxy-1-naphthol, etc.), and the like. As the reducing agent for silver behenate, there are many compounds such as o-bisphenols of the bis(hydroxyphenyl)methane series, hydroquinone and the like. Also, as the reducing agent for silver caprate and silver laurate, there are substituted tetrakisphenols, o-bisphenols of the bis(hydroxyphenyl)alkane series, p-bisphenols (e.g., a bisphenol A derivative), p-phenylphenols, and the like. Acceptable reducing agents/organic silver salt combinations can easily be determined by a simple test. For example, a sample of the reducing agent is mixed with a coating solution containing the organic silver salt, and the mixed coating solution coated on the support. The resulting heat-developable light-sensitive sample is then exposed and heated; examination at this stage easily permits one skilled in the art to determine optimum combination.

The amount of the reducing agent used in the present invention varies depending upon the kind of the organic silver salt or the reducing agent and upon other additives, but, in general, a suitable amount ranges from about 0.05 mol to about 10 mols, preferably from about 0.1 to about 3 mols, per 1 mol of the organic silver salt.

The above-described various reducing agents may be used as combinations of two or more thereof. Specific examples using two reducing agents in combination are described in Japanese Patent Application (OPI) No. 115540/74 and U.S. Pat. Nos. 3,667,958, and 3,751,249. As a particularly effective combination of reducing agents, there are illustrated the combination of at least one carboxylic acid ester derived from a phenol having a bulky o-substituent and an o- or p-bisphenol, the carboxylic acid ester being the aforesaid ester between a carboxylic acid derived from a phenol having a bulky o-substituent and a mono- or poly-hydric alcohol or a phenol or the ester between an alcohol derived from a polyhydric phenol having a bulky o-substituent or from a phenol having a bulky o-substituent and a mono- or poly-carboxylic acid. This combination enables one to attain a reduction of heat fog, an increase in whiteness and a stabilization against light exposure after processing. In addition, the combined use of two mono- or poly-phenolic reducing agents having alkyl groups at the two substitution positions adjacent the hydroxy-substituted position of the aromatic nucleus is effective for preventing discoloration upon exposure to light. Further, it has been confirmed that development can be accelerated by the combined use of a compound of tin, iron, cobalt or nickel, for example, a metal salt of a long chain fatty acid, e.g., iron stearate, lead behenate, etc. (such compounds are auxiliary reducing agents), and the reducing agent. The amounts of these auxiliary reducing agents vary widely depending upon the reducing power of the main reducing agent and the auxiliary reducing agent and the reducibility of the oxidizing agent (the organic silver salt), but, in general, they are used in an amount of from about $10^{-5}$ to about 1 mol, preferably from $10^{-3}$ to 0.8 mol, per 1 mol of the main reducing agent.

A toning agent may be used in combination with the reducing agent(s). A toning agent is used by preference in the case where a deep-colored image, particularly a black image, is desired. The amount of toning agent used is from about 0.0001 mol to about 2 mol, preferably from about 0.0005 mol to about 1 mol, per mol of the organic silver salt. The effectiveness of a toning agent depends on the kind of organic silver salt and reducing agent used.

Examples of most commonly used toning agents include heterocyclic organic compounds having a

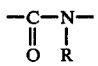

unit, such as phthalazinones, oxazolidinediones, cyclic imides, quinazolinones, N-hydroxyphthalimides, urazoles, 2-pyrazolin-5-ones, and the like. Examples of typical toning agents include phthalazinone, 2-acetylphthalazinone, 2-phthalylphthalazinone, N-methylphthalazinone, 2-pivaloylphthalazinone, 2-carbamoylphthalazinone, 2-(3,4-dimethoxybenzoyl)phthalazinone, 2-lauroylphthalazinone, 2-benzoylphthalazinone, 2-(p-methoxybenzoyl)phthalazinone, 2-ethoxyformylphthalazinone, phthalazinone derivatives as described in U.S. Pat. No. 4,076,534 and U.S. Pat. No. 3,844,797; phthalazinone salts such as the silver salt of phthalazinone, etc., quinazolinediones, benzoxadinediones and naphthaxadinediones, such as those described in Japanese Patent Applications (OPI) Nos. 91,215/74 and 2,524/75; cyclic imides such as substituted phthalimides, etc., as described in German Patent Applications (OLS) Nos. 2,141,406 and 2,141,063; quinazolinones such as those described in U.S. Pat. No. 3,846,136; pyrazoline-5-one, N-hydroxynaphthalimides as described in U.S. Pat. No. 3,782,941; mercapto compounds as described in U.S. Pat. No. 3,832,186 and Japanese Patent Application (OPI) No. 5,020/74; phthalazinediones as described in Japanese Patent Application (OPI) No. 67641/75; uracil, barbituric acid, saccharin, 5-nitrosaccharin, phthalic anhydride, sulfolene, 2-mercaptobenzoxazole, 2-hydroxybenzothiazole, 2-amino-6-methylbenzothiazole, 2-amino-4-(4-biphenyl)thiazole, imidazole, 2-hydroxybenzimidazole, N,N'-ethylenethiourea, 1-acetyl-2-thiohydantoin, and the like.

Image tone may also be blackened using imidazoles in combination with phthalic acid, naphthoic acid or phthalamic acid, as described in U.S. Pat. No. 3,847,612. As an example of an equally favorable combination, mention may be made of phthalazinone and 2-acylphthalazinone. Two or more of the above described toning agents may, of course, be used at the same time to give good photographic properties, if desired. Satisfactory results may also be obtained by adding the toning agents to the support, by applying them on the back surface of the support, or in a subbing or an overcoating layer.

In order to prevent thermal fog of the thermally developable light-sensitive element of this invention, various methods may be applied, including using mercury compounds as described in U.S. Pat. No. 3,589,903. It is possible to obtain a direct positive image by utilizing mercury compounds as described in U.S. Pat. No. 3,589,901. In addition, in order to obtain a stable color image, mercury compounds may also be used in combination with a color-forming coupler as described, for example, in U.S. Pat. No. 3,764,328. By using mercury compounds or certain N-halogenated compounds, a thermally developable light-sensitive element can be obtained which is, before being heated, stable against light and can be rendered sensitive by preheating before image exposure, as described in U.S. Pat. Nos. 3,764,329, 3,802,888 and 3,816,132, and Japanese Patent Applications (OPI) Nos. 89,720/73, 10,039/74 and 91,214/74.

Furthermore, it is possible to change the sensitivity or contrast of the element of this invention by heating it before image-wise exposure. Other methods for preventing thermal fog include adding N-halogeno compounds, such as N-halogeno succinimides, N-halogeno acetamides, N-halogeno oxazolinones, N-halogeno benzotriazoles, N-halogeno benzimidazoles, N,N'-dichloro-1,2-ethylenebisbenzamide, etc., as described in Japanese Patent Applications (OPI) Nos. 10,724/74, 97,613/74 and 90,118/74, and U.S. Pat. No. 4,009,039.

Still other methods for preventing thermal fog include employing acidic compounds or salts thereof, as described in Japanese Patent Applications (OPI) Nos. 12,501/74, 130,720/74 and 89,720/74, U.S. Pat. No. 3,645,739, Japanese Patent Applications (OPI) Nos. 57619/75, 47419/76, 54428/76, British Pat. No. 1,476,875 and U.S. Pat. No. 4,039,334. Examples of such acids include lauric acid, myristic acid, palmitic acid, stearic acid, behenic acid, succinic acid, maleic acid, tetrahalogenophthalic acids or their derivatives, aryl sulfonic acids, such as benzenesulfonic acid and p-toluenesulfonic acid, arylsulfinic acids or their salts, such as benzenesulfinic acid and p-toluenesulfinic acid, citric acid, rosinic acid, salicylic acid, p-hydroxybenzoic acid, 2,6-dihydroxybenzoic acid, tetrabromobenzoic acid, p-acetamidobenzoic acid, alkyl-substituted benzoic acids, such as p-t-butylbenzoic acid, etc., phthalic acid, isophthalic acid, trimellitic acid, pyromellitic acid, diphenic acid, 5',5'-methylene-bissalicylic acid, capric acid, arachic acid, lignoceric acid, cerotic acid, linolic acid, oleic acid, adipic acid, sebacic acid, dimethylstearic acid, dimethylbehenic acid, cinnamic acid, o-phthalamic acid, naphthoic acid, diterpenes, alkali salts or esters of benzenethiosulfonic acid, and combinations thereof, such as sulfinic acids and halogenated phthalic acids, sulfinic acids and rosins or diterpenes, thiosulfonic acids and imidazoles, and the like.

There may also be used as stabilizers salts such as lithium salts of higher fatty acids, for example, lithium myristate, stearate, behenate, palmitate, and the like. In many cases, these acid stabilizers are effective not only for preventing thermal fog but also for preventing light discoloration of the processed element upon exposure to white light, for increasing image density, and for improving shelf life.

Still other examples of compounds effective for the prevention of thermal fog include phenylmercaptotetrazoles; thiouracils, such as those described in U.S. Pat. No. 4,002,479; 2-thiouracils, such as those represented by the following formula:

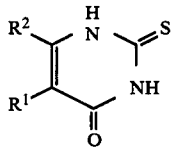

(wherein $R^1$ represents a hydrogen atom, a hydroxyl group, an alkoxyl group, a halogen atom, a lower unsubstituted alkyl group, a benzyl group, an allyl group, an amino group, a nitro group or a nitroso group; and $R^2$ represents a hydrogen atom, a hydroxyl group, a halogen atom, an amino group, an acetamide group, a substituted or unsubstituted alkyl group having 1 to 22 carbon atoms, a phenyl group, or a substituted aryl group); peroxides and persulfates, such as those described in Japanese Patent Application (OPI) No. 42529/76; and palladium-containing compounds, including a palladium-acetylacetone complex, as described in Japanese Patent Application (OPI) No. 51323/76.

It is also effective, to improve photographic properties, such as to prevent fog and for sensitization, to effect the formation of silver halide in the presence of rhodium or cobalt salts, as described in Japanese Patent Applications (OPI) Nos. 116024/75 and 134421/75. Other examples of equally effective metal salts or complexes include those of chromium, copper, nickel, iron, and the like.

The thermally developable light-sensitive materials of the present invention can contain a antistatic layer or a conductive layer, if desired. Halogenides, water soluble salts such as nitrates, ionic polymers as disclosed in U.S. Pat. Nos. 2,861,056 and 3,206,312; or insoluble inorganic salts as disclosed in U.S. Pat. No. 3,428,451 can be additionally incorporated in these layers. Furthermore, a thin metallic layer prepared by evaporation may be present.

In the thermally developable light-sensitive material employed in the practice of the present invention, antihalation substances or antihalation dyes can be optionally incorporated. Heat decolorizable dyes are preferred as antihalation agents. For example, such dyes as are disclosed in U.S. Pat. Nos. 3,769,019 and 3,745,009, and Japanese Patent Publication No. 43,321/74 are preferably used in the present invention. In addition, the thermally developable light-sensitive materials of the present invention can contain filter dyes and light-absorbing substances as disclosed in, for example, U.S. Pat. Nos. 3,253,921, 2,527,583, 2,956,879 and 2,274,782. The thermally developable light-sensitive materials of the present invention can optionally contain matting agents such as calcium carbonate, starch, titanium dioxide, zinc oxide, silica, dextrin, barium sulfate, alumina, kaolin, clay, diatomaceous earth and so on.

Fluorescent whiteness increasing agents such as stilbenes, triazones, oxazoles, coumarin and so on as disclosed in, for example, German Pat. Nos. 972,067 and 1,150,274, French Pat. No. 1,530,244, and U.S. Pat. Nos. 2,933,390 and 3,406,070 may also be used in the present invention. These fluorescent whiteness increasing agents are used as an aqueous solution or a dispersion.

The thermally developable light-sensitive materials of the present invention can further contain plasticizers and lubricants. As examples of preferred plasticizers or lubricants, mention may be made of glycerin, diols, polyhydric alcohols as disclosed in, for example, U.S. Pat. No. 2,960,404; fatty acids and esters thereof as disclosed in, for example, U.S. Pat. Nos. 2,588,765 and 3,121,060; and silicone resins as disclosed in, for example, British Pat. No. 955,061. Surface active agents, for example, saponin and alkyl aryl sulfonates as disclosed in, for example, U.S. Pat. No. 2,600,831; amphoteric compounds as disclosed in, for example, U.S. Pat. No. 3,133,816; and glycidol-alkylphenol adducts and alkoxyphenol series surface active agents as disclosed in, for example, British Pat. No. 1,022,878 can also be incorporated into the thermally developable light-sensitive materials of the present invention.

Certain layers of the thermally developable light sensitive elements, for example, a light-sensitive layer, which undergo a hardening treatment, can be hardened using various organic and inorganic hardeners in the practice of the present invention. Hardening agents can be used either singly or in combination. Preferred examples of hardeners include aldehydes, blocked aldehydes, ketones, carboxylic acids and carbonate derivatives, sulfonate esters, sulfonyl halides, vinylsulfonyl esters, active halogeno compounds, epoxy compounds, aziridenes, active olefins, isocyanates, carbodiimides, polymeric hardeners such as dialdehyde starchs, and so on.

Further, various additives can be added to increase image density. For example, compounds containing —CO—, —SO— or —$SO_2$— groups as disclosed in, for example, U.S. Pat. No. 3,667,959; and non-aqueous organic polar solvents such as tetrahydrothiophene-1,1-dioxide, 4-hydroxybutanonic lactone and methylsulfinyl methane are suitable for this purpose. Besides these, acetates of zinc, cadmium and copper as disclosed in U.S. Pat. No. 3,708,304 are effective.

Further, compounds which change into alkaline compounds on heating such as the compounds containing water of crystallization as disclosed in U.S. Pat. Nos. 3,635,719 and 3,531,285; guanidinium salts, acidic salts of amines and metal oxides or hydroxides are effective for accelerating development. For the purpose of increasing the developing speed, moisture-releasing agents can be optionally added. Moisture-releasing agents include not only the above-described compounds containing water of crystallization and metal hydroxides, but also ureas, caprolactam, p-nitroethanol, β-cyanoethanol, glycol, polyethylene glycol, glycerol, sorbitol, and mono- or oligosaccharides.

Besides the above-described additives, the combination of a polyalkylene glycol and mercaptotetrazole can also be employed to improve sensitivity, contrast and image density. Moreover, leuco-dye compounds as disclosed in U.S. Pat. No. 4,021,250 can be employed to further improve the green shelf life.

Further, it is possible to increase the whiteness by blueing by the addition of blue dyes such as Victoria Blue to result in an improvement of the residual color produced by the dyes.

In the thermally developable light sensitive materials of the present invention, a subbing layer may be provided between the support and the heat developable light sensitive layer(s) coated on the support.

Polymer acids containing a behenic acid unit, a palmitic acid unit, a lauric acid unit, a rosin unit, a diterpenic acid unit, a polyacrylic acid unit, a maleic acid unit or an acrylic acid unit, benzotriazoles, mercaptoazoles, metal salts of fatty acids such as lithium laurate, lithium behenate, etc., and so on can be incorporated into the subbing layer to improve photographic characteristics such as the color change by light and thermal fog. Further, it is possible to prvent the emulsion from permeating into the support and to increase resolution by incorporating matting agents such as clay, kaolin, starch, barium sulfate, alumina, silica, titanium dioxide, zinc oxide and the like into the subbing layer. Also, a conductive metal layer produced by an electrolytic process may be used as a subbing layer.

Moreover, a polymer layer is preferably provided on the back side of a paper support to increase moisture resistance, to protect the support from curling, to facilitate note making and to prevent color toning agents or sublimating compounds from transfering from emulsion layers or the like. Polymers employed for the back layer include gelatin, polyvinyl alcohol, polyvinyl pyrrolidone, cellulose acetate butyrate, acrylate copolymers, polyamide resins, coumaronindene resins, cellulose diacetate, ethyl cellulose, the above-described polymers employed for the subbing layer and binders for emulsions as described hereinafter. This back polymer layer can additionally contain the above-described color toning agent and reducing agent, dyes and other additives. Further, thermally developable light sensitive materials which have a back layer containing a heat transferable dye can be employed as a thermally transfer material. As to these thermally transfer materials, descriptions are given in patents such as U.S. Pat. No. 3,767,394 and Japanese Patent Application (OPI) No. 103639/74.

A polymer final coat can optionally be provided on a light sensitive layer to increase the transparency of a thermally developable light sensitive layer, increase image density, and improve upon the green shelf life, as disclosed in Japanese Patent Applications (OPI) Nos. 6917/74 and 128726/74, Japanese Patent Application (OPI) No. 46316/75, Belgian Pat. No. 798,367; and U.S. Pat. Nos. 3,856,526 and 3,856,527. A polymer final layer coated in a thickness ranging from about 1 micron to about 20 microns is most suitable for use. Suitable polymers for the polymer layer include polyvinyl chloride, polyvinyl acetate, vinyl chloride-vinyl acetate copolymers, polystyrene, polymethylmethacrylate, methylcellulose, ethylcellulose, cellulose acetate butyrate, cellulose acetate, polyvinylidene chloride, cellulose propionate, cellulose acetate phthalate, polycarbonate, cellulose acetate propionate, polyvinyl pyrrolidone, polyvinyl toluene, nitrocellulose, styrene-isobutylene copolymers, gelatin, a polymer latex, e.g., 2-acetoacetoxyethylmethacrylate, and carboxy-polyesters.

It is possible to make notes with stamp-ink, cinnabar seal ink, ballpoint ink or a pencil on a polymer final coat by incorporating therein a carrier such as titanium dioxide, kaolin, zinc oxide, silica, alumina, polysaccharides such as starch, and the like. In addition, the polymer final coat can contain antihalation dyes, filter dyes, ultraviolet-ray absorbing agents, acid stabilizers such as higher fatty acids and color toning agents such as phthalazinone.

Each component employed in the present invention is preferably dispersed into at least one colloid which can be used as a binder. Most well-suited binders are, in general, hydrophobic ones, but hydrophilic binders may also be used. These binders are transparent or translucent, and include, for example, gelatin, proteins such as gelatin derivatives, cellulose derivatives, polysaccharides such as dextran, natural substances such as gum arabic, latex-like vinyl compounds of the kind which increase the dimensional stability of the materials and synthetic polymers as hereinafter described. Suitable synthetic polymers are disclosed in U.S. Pat. Nos. 3,142,586; 3,193,386; 3,062,674; 3,220,844; 3,287,289 and 3,411,911. Effective polymers include water-insoluble polymers containing as a monomer unit alkyl acrylates, alkyl methacrylates, acrylic acid, sulfoalkyl acrylates, sulfoalkyl methacrylates or the like, and polymers containing a repeating sulfobetaine unit as disclosed in Canadian Pat. No. 774,054. Additional suitable macromolecular compounds and resins for use as a binder include polyvinyl butyral, polyacrylamide, cellulose acetate butyrate, cellulose acetate propionate, polymethylmethacrylate, polyvinyl pyrrolidone, polystyrene, ethylcellulose, polyvinyl chloride, chlorinated rubber, polyisobutylene, butadiene-styrene copolymers, vinyl chloride-vinyl acetate copolymers, vinyl chloride-vinyl acetate-maleic acid terpolymers, polyvinyl alcohol, polyvinyl acetate, benzyl cellulose, cellulose acetate, cellulose propionate, cellulose acetate phthalate, polyvinyl formal, polyvinyl pyridine, polyvinylidene chloride, methyl vinyl ether-maleic anhydride copolymers, polyvinyl acrylamide, cellulose nitrate, butylcellulose, carboxymethylcellulose, hydroxyethylcellulose, nitrocellulose, polyethylene, polyethylene glycol, polyethylene oxide, polyacrylates, polysulfoalkylacrylates, polysulfoalkylmethacrylates, polyamides, terpene resins, alginic acid and the derivatives thereof, onium halide series conductive polymers and phenol resins. Of these polymers, particularly preferred polymers are polyvinyl butyral, polyvinyl acetate, ethylcellulose, polymethylmethacrylate, cellulose acetate butyrate, gelatin and polyvinyl alcohol. These polymers may be used in combination, if desired. A preferred weight ratio of the amount of the binder to that of component (a), the organic silver salt(s), ranges from about 10:1 to about 1:10, particularly preferably about 4:1 to 1:4.

A lithographic plate can also be made by using a special binder as disclosed in Japanese Patent Application (OPI) No. 4659/72 and U.S. Pat. No. 3,679,414. Also, a lithographic plate can be made by taking advantage of a special layer structure as is disclosed in U.S. Pat. No. 3,811,886.

Further, the method disclosed in U.S. Pat. No. 3,767,394 and Japanese Patent Application (OPI) No. 103639/74 applied to the present light sensitive system enables the system to be employed as a thermal transfer sheet.

Layers containing each of the components employed in the thermally developable light sensitive materials of the present invention, and other layers, may be coated on a support selected from a wide variety of materials. These supports may have any shape. However, film-, sheet-, roll- and ribbon-like shapes, commonly preferred as flexible supports, are advantageous on handling as an information recording material.

Materials useful as the support include plastic film, sheet, glass, wool, cotton cloth, paper and metals such as aluminum. As plastic films, cellulose acetate film, polyester films, e.g., polyethylene terephthalate film, polyamide film, polyimide film, triacetate film, polycarbonate film, orientated polyethylene telephthalate film, cellulose nitrate film, cellulose ester film, polyvinyl acetal film, polystyrene film, polyethylene terephthalate film colored by titanium dioxide or the like, heat decolorizable dye-containing films, polyester films having a hydrophilic surface prepared by dispersing silica or the like and a partially hydrolyzed vinyl chloride-vinyl acetate copolymer, and polyethylene terephthalate film on which a gelatin subbing layer is provided can be employed. Examples of paper supports include not only generally used paper, but also photographic raw paper, printing paper such as coated paper and art paper, baryta-paper, resin-coated paper, water-proof paper, paper having received a sizing treatment using a polysaccharide or the like as disclosed in Belgian Pat. No. 784,615; partially acetylated paper, pigmented paper containing titanium dioxide or the like, α-olefin polymer (e.g., polyethylene, polypropylene, ethylene-butene copolymers, etc.) coated paper, paper having received a preliminary treatment with polyvinyl alcohol or a metallic thin film, film or paper endowed with conductivity by having received a carbon treatment, gelatin undercoated paper, glassine paper, kent paper, map overlay coated paper, paper having a surface made up of clay, insolubilized casein or carboxymethylcellulose, paper having received a calendering treatment, paper impregnated with or coated by acidic polymers, and so on.

Besides the above, an aluminum plate under-coated with polyacrylamide, an aluminum plate having received a treatment with a hydrophilic silicate, and a support containing as a subbing layer a conductive metal layer can be also used.

Patterns can be optionally engraved on either the upper layer or the back layer of the support. Engraving of this kind is required for making a post card or a commutation ticket.

The above described various kinds of layers are generally provided on one of the aforesaid supports, but some components can be incorporated into the support itself. Incorporation of some components into a support such as a plastic film, glass or metal film is, of course, accompanied with many difficulties in permitting the components to efficiently exert their intended effect. However, the incorporation of some components into a paper support permits the components to exert their effect to the same extent as the incorporation of them into any layer provided on a support.

An anti-foggant, a toning agent and an antihalation agent are examples of materials which may be incorporated into the support. In the present invention, an organic silver salt, a photocatalyst and, optionally, a sensitizing dye can be incorporated in the same layer (i.e., this layer is called a photosensitive layer), if desired. In this invention components (a), (b) and (c) must be incorporated in the same layer. Therefore, toning agent, anti-foggant and anti-discoloration agent may be incorporated in another layer.

Other ingredients of the present invention (such as a reducing agent, a toning agent, an anti-fogging agent and an ultraviolet absorbing agent, etc.) can be incorporated in the above photosensitive layer, or another layer on the support such as the subbing layer or a protective layer, if desired.

In the present invention, it is most preferred to incorporate an organic silver salt, a photocatalyst, a reducing agent, a toning agent, an anti-foggant and a binder in one layer on the support.

The light-sensitive composition is coated on a support at a coverage ranging from about 0.2 g to about 3 g, preferably from about 0.3 g to about 2 g, in terms of silver content in both the organic silver salt and the silver halide, per square meter of support. When the coating amount is less than the aforesaid lower limit, the maximum density of the resulting image becomes too low, while there is a tendency for the maximum density of the image to be saturated in the range more than the upper limit. Therefore, an excess amount of coating over the aforesaid upper limit increases the cost of the product.

The thermally developable light-sensitive element of this invention can be prepared in the manner outlined below. The organic silver salt is prepared by allowing an organic silver halide-yielding component to react with a silver ion-yielding agent, e.g., silver nitrate, according to the method was described above. The reaction is usually carried out at atmospheric pressure at an appropriate temperature of from about −15° C. to about +80° C., preferably from about 20° C. to about 60° C. The thus prepared silver salt is washed with water, alcohols or the like, and then dispersed into a binding agent by the use of, for example, a colloid mill, a mixer or a ball mill. The dispersing step is usually carried out at ordinary temperature (15° C. to 25° C.). To this dispersion of silver salt in polymer is added the compound of the present invention, and the resulting mixture is allowed to stand for a definite time, preferably with heating. To this is added a silver salt-yielding agent in order to convert a part of the organic silver salt to silver halide. The reaction is preferably carried out at a temperature of from ordinary temperature to about 80° C. The reaction time can be arbitrarily varied in the range of from about 1 minute to about 48 hours. To the resulting mixture are added, in succession, various additives, such as a sensitizing dye, a reducing agent, a toning agent and the like, preferably in the form of solutions, to give a finished coating solution. The addition is usually carried out with stirring at a temperature of from ordinary temperature to about 50° C. at appropriate intervals (usually 5 to 20 minutes). The thus prepared coating solution is coated on an appropriate support without being dried. In addition to this thermally developable light-sensitive layer, other layers such as an overcoating polymeric layer, a subbing layer, a backing layer, etc., can be applied from corresponding coating solutions by various coating techniques, including dipping, air knife coating, curtain coating or hopper coating. If desired, two or more layers can be coated at the same time by the method as described, for example, in U.S. Pat. No. 2,761,791 and British Pat. No. 837,095.

If desired, a pattern can be printed on the surface or back surface of the support, or on the surface of a layer coated thereon. By printing a definite pattern, the element of this invention can be used as a commuting ticket, a postcard, and the like.

The thus prepared thermally developable light-sensitive element can be cut to an appropriate size adapted for its use, if necessary, and then be subjected to an image-wise exposure. If necessary, it can be subjected to preheating (80° C. to 140° C.) before the exposure. Examples of light sources suitable for the exposure include tungsten lamps, fluorescent lamps such as those mainly used in coping machines for diazo materials, mercury lamps, xenon lamps, CRT light sources, laser light sources, and the like. The element of this invention can be used for the coping of originals having either a line image or a photographic image with gradation, and can be used in a camera to take pictures such as of men and landscapes. The element can be subjected to printing by a contact, reflex, or enlargement printing method. The amount of light for exposure can be varied from about 10 lux·sec. to about $10^4$ lux·sec., depending on the speed of the element. The thus exposed element can be developed merely by being subjected to heating at a temperature of from about 80° C. to about 180° C., preferably from about 110° C. to about 150° C. The heating time can be arbitrarily varied from 1 to 60 seconds, depending on the heating temperature. It is usually from about 5 to about 40 seconds at 120° C., from about 2 to about 20 seconds at 130° C., and from about 1 to 10 seconds at 140° C. Various methods can be employed for heating. For example, the light-sensitive element can be brought into contact with a simple heated plate or a heated drum, can be allowed to pass through a heated area, or can be subjected to high frequency or laser beam heating as described in U.S. Pat. No. 3,811,885. In order to remove odor generated during heating, there can be used a processer equipped with a deodorant. In order to mask the odor of the light-sensitive element, there can also be used a various perfumes, e.g., as described in Japanese Patent Application (OPI) No. 10925/76.

The thermally developable light-sensitive element of this invention is generally sensitive to moisture. Therefore, it is desirable to use drying agent in its package, as described in Japanese Patent Application (OPI) No. 2,523/74.

The thermally developable light-sensitive element of this invention is highly useful because of such features as reduced light discoloration and improved whiteness.

This invention will now be further illustrated by the following non-limiting examples.

EXAMPLE 1

Into 100 ml of water was dissolved 1.9 g of sodium hydroxide, and the resulting solution was emulsified at 25° C. into a solution of 12 g of lauric acid in 100 ml of toluene. To this was added a solution of 8.5 g of silver nitrate in 50 ml of water. Upon being allowed to stand for 5 minutes, the mixture separated into water layer and a toluene layer containing silver laurate. The water layer was removed and 200 ml of ethanol was added to the toluene layer to disperse the silver laurate. The silver laurate was collected by centrifugation. 12 g of spindle shaped crystals having a major diameter of about 3 microns were obtained. (Silver laurate could be obtained in an almost equal manner using benzene, pentane, cyclohexane, butyl acetate, isoamyl acetate, butyl alcohol, tricresyl phosphate, dibutylphthalate, etc., in place of toluene in the above preparation.)

Into 70 g of ethyl alcohol were dispersed 6 g (ca. 1/50 mol) of silver laurate obtained above and 12 g of polyvinyl butyral (12 g of ethyl cellulose could be used with equal success) by the use of a mixer to prepare a silver salt dispersion in the polymer (similar results could be obtained using methanol, propanol or isopropanol in place of ethanol). Maintaining the temperature of the dispersion at 50° C., 20 ml of a 0.01 wt% solution of benzotriazole, component (d) of this invention, in methanol was added therein with stirring. The stirring was continued 10 minutes. To this was added 0.15 g of N-bromosuccinimide (silver halide-yielding component), and the resulting mixture was heated to 90° C. (other N-halogeno compounds such as N-bromoacetamide, N-bromophthalazinone, etc., can also be used in place of N-bromosuccinimide, of course).

The temperature of the dispersion was then lowered to 30° C., and the following components were added in sucession in their recited order at intervals of 5 minutes with stirring at 30° C.

(1) A solution (10 ml) of 0.025 wt% of the following dye (sensitizing dye) in 2-methoxyethanol

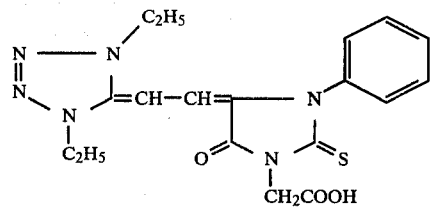

(other merocyanine dyes, cyanine dyes, acidic dyes, etc., could be used in place of the above dye).

(2) A solution (100 ml) of 3 wt% of phthalazone (toning agent) in 2-methoxyethanol, and (3) A solution (25 ml) of 20 wt% of tetrakis-[methylene-(3,5-di-t-butyl-4-hydroxyhydrocinnamate)]methane (reducing agent) in acetone.

The thus prepared coating solution was coated onto a conventional paper support (art paper, coated paper, papers for use in photography or carbonless duplication, etc., can be used with equal success) at a silver coverage of 0.3 g per square meter of the support. Onto this light-sensitive layer was coated a dispersion of silica in a 10 wt% ethanol solution of cellulose diacetate to form a polymeric overcoating layer having a thickness of about 1.5 microns (the ratio, by weight, of silica to cellulose diacetate was 1/10). The thus prepared thermally developable light-sensitive element was designated Sample (A).

For purposes of comparison, thermally developable light-sensitive element (B) was prepared in a similar manner as above, except that component (d) was not used.

Samples (A) and (B) were image-wise exposed to tungsten light through an original with gradation (the amount of exposure light was $10^3$ lux·sec.), and then developed by heating for 10 seconds at 125° C. After development, each sample was exposed to room light for one day. The results obtained are shown in the following Table.

| Sample | (A) | (B) |
|---|---|---|
| $D_{max}$ | 1.45 | 1.45 |
| Fog | 0.15 | 0.16 |
| Color in Background | White | Pink |
| Light Discoloration | Scarcely Proceeded | Considerably Proceeded |

Sampe (A), which had benzotriazole incorporated therein before the addition of the silver halide-yielding agent, had reduced light discoloration and increased whiteness. From these results, the effects of the incorporation of benzotriazole are apparent.

EXAMPLE 2

Sample (C) was prepared as in Example 1, except that 15 ml of a 0.08 wt% solution of 2-hydroxybenzimidazole in methanol was used in place of the solution of benzotriazole (component (d)) in Example 1. Sample (D) was prepared in a similar manner, except that the solution of 2-hydroxybenzimidazole was not used.

These samples were exposed in the same manner as in Example 1 and developed by heating for 10 seconds at 125° C. The developed samples were attached to a windowpane and exposed to sunlight for half a day. The results obtained are shown in the following Table.

| Sample | (C) | (D) |
|---|---|---|
| $D_{max}$ | 1.44 | 1.46 |
| Fog | 0.15 | 0.16 |
| Density in Background (fog)* | 0.18 | 0.32 |
| Color in Background* | Substantially White to Pink | Light Brown |

*After exposure to sunlight

The Table shows that Sample (C), which had 2-hydroxybenzimidazole added, had a remarkably reduced light discoloration and increased whiteness.

EXAMPLE 3

This example illustrates the effects of changing the time of adding component (d).

Sample (C) was prepared as in Example 2, except that the incorporation of 2-hydroxybenzimidazole was carried out 10 minutes before the incorporation of N-bromoacetamide, the silver halide-yielding component; Sample (D) was prepared in the same manner as in Example 2; Sample (E) was prepared as in Example 2, except that the incorporation was carried out 45 minutes after the incorporation of N-bromoacetamide; Sample (F) was prepared as in Example 2, except that the incorporation was carried out 90 minutes after the incorporation of N-bromoacetamide; and Sample (G) was prepared as in Example 2, except that component (d) was incorporated after the incorporation of the reducing agent.

After exposure and development as in Example 1, the samples were exposed to room light for one day, attached to a windowpane and then exposed to sunlight for half a day in order to compare coloring in background areas. Results obtained are shown in the following Table.

| Sample | (C) | (D) | (E) | (F) | (G) |
|---|---|---|---|---|---|
| $D_{max}$ | 1.44 | 1.46 | 1.45 | 1.45 | 1.43 |
| Fog | 0.15 | 0.16 | 0.16 | 0.15 | 0.16 |
| Color in Background after Exposure to Room Light | White | Pink | white to Pink | Pink | Pink |
| Density in Background Area | 0.16 | 0.20 | 0.18 | 0.19 | 0.21 |
| Color in Background after Exposure to Sunlight | Almost White to Pink | Light Brown | Pink | Pink to Light Brown | Light Brown |
| Density in Background Area | 0.18 | 0.32 | 0.24 | 0.29 | 0.33 |

The above results show that the effects of the invention are (C)>(E)>(F)>(D)≃(G), and Sample (G) gives almost the same results as Sample (D), which does not have component (d) added, that is, Sample (G) exhibits no effects due to the incorporation of component (d).

It will be understood by comparing (C), (E) and (F) that component (d) exhibits greater effects when it is incorporated before the incorporation of N-bromoacetamide.

EXAMPLE 4

To a solution of 8.6 g of capric acid in 100 ml of butyl acetate maintained at 5° C. was added, with stirring, 50 ml of an aqueous silver nitrate-ammonium complex solution containing 8.5 g of silver nitrate and the system cooled to 5° C. To this solution was added 8 ml of a 0.1 wt% solution of 5-methylbenzotriazole in methanol, and the resulting mixture stirred for 10 minutes. To this was further added 20 ml of a 2.5 wt% aqueous hydrogen bromide solution, and the resulting mixture stirred for 20 minutes.

After the removal of the water layer, the isopropanol layer containing silver caprate and silver bromide was dispersed into 120 g of a 15 wt% polyvinyl butyral solution in isopropanol to give a polymer dispersion of the silver salts.

To this dispersion was added 50 ml of a 20 wt% p-phenylphenol (reducing agent) solution in acetone at 40° C. The resulting composition was coated on a support (art paper, resin coated paper, or the like) at a coverage of silver of 0.4 g per square meter of the support. The thus formed thermally developable light-sensitive element was designated Sample (H).

Sample (I) was prepared in a similar manner as above, except that 3-methylbenzotriazole was not used.

The samples were exposed in the same manner as in Example 1, and then developed by heating for 15 seconds at 110° C. The background areas of the developed samples showed no differences in fogging, but Sample (H) which had added thereto 3-methylbenzotriazole had greater whiteness and showed a reduced discoloration (to pink) caused by exposure to room light.

EXAMPLE 5

Into 100 ml of benzene was dissolved 3.4 g of behenic acid at 60° C. Maintaining the temperature of the resulting solution at 60° C., 100 ml of water was added and dispersed therein with stirring. To this was added a solution of a silver-ammine complex prepared by mixing a solution of 1.7 g of silver nitrate in about 80 ml of water with ammonium water, and then adding water to the solution to make the total volume 100 ml.

The resulting mixture containing crystals of silver behenate was allowed to stand at ordinary temperature (20° C.). After 20 minutes, the mixture was separated into water layer and benzene layer. The water layer was removed, and 400 ml of water was added to the benzene layer to wash it by decantation.

To the washed mixture was added 400 ml of methanol, and the silver behenate was collected by centrifugation. 4 g of spindle shaped crystallites of silver behenate having a major diameter of about 1 micron and a minor diameter of about 0.5 micron were obtained.

Into 20 ml of an ethanol solution containing 2.5 g of polyvinyl butyral was dispersed 2.3 g (ca. 1/200 mol) of the silver behenate obtained above. The resulting mixture was heated to 50° C. To this mixture was added 3 ml of a 0.03 wt. % solution of 5-octyloxybenzotriazole in ethanol, and the system stirred for 20 minutes. After the temperature had been reduced to 30° C., the following components were added in succession in their recited order at intervals of 5 minutes to form a coating solution.

(a) A solution (1 ml) of 2.5 wt% of ammonium bromide (silver halide-yielding component) in methanol (b) A solution (1 ml) of 0.025 wt% of the following merocyanine dye (sensitizing dye) in 2-methoxyethanol

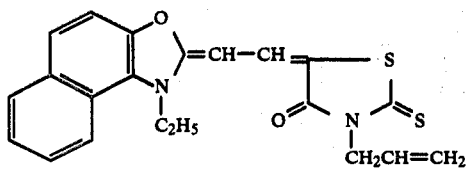

(c) A solution (3 ml) of 25 wt% of 2,2'-methylenebis(6-t-butyl-4-methylphenol) (reducing agent) in acetone, and (d) A solution (3 ml) of 2.5 wt% of phthalazone (toning agent) in 2-methoxyethanol Almost equal photographic properties could be obtained by using an equimolar amount of inorganic halides, such as hydrogen bromide, sodium bromide, potassium bromide, calcium bromide, and antimony bromide, in place of the above ammonium bromide.

In cases where other merocyanine dyes were used in place of the above merocyanine dye, sensitivities several times as great or several times as small as that of the above elements were obtained. Most preferred results were obtained in cases where merocyanine dyes were used that contained a carboxyl group and a nucleus selected from rhodanines, thiohydantoin, 2-thio-2,4-oxazolidinedione or pyrazoles, where sensitivities about 5 times as great as that of the above element were obtained.

The thus prepared coating solution was coated on a support (which may be any of art paper, coated-paper, and paper for use in photography) at a coverage of silver of 1 g per square meter to give a thermally developable light-sensitive element. The element was designated Sample (J).

For comparison, Sample (K) was prepared as above, except that component (d) of the present invention was not incorporated.

The thus prepared thermally developable light-sensitive elements (J) and (K) were image-wise exposed through an original with gradation to tungsten light at an exposure amount of $10^4$ lux·sec., and then developed by heating for 20 seconds at 120° C. Similar results could be obtained using a mercury lamp, a xenon lamp, a CRT light source, a fluorescent lamp, a laser light, etc., at the same amount of exposure instead of the above tungsten lamp.

The samples were attached to a windowpane and exposed to sunlight for one day in order to compare the coloring in background areas thereof.

The background areas in Sample (J) remained substantially white or showed only a slight pink, whereas the background areas in Sample (K) colored to light brown. The results show the effectiveness of this invention. There were no differences in other photographic properties such as sensitivity, $D_{max}$, fog, etc.

While the invention has been described in detail and with reference to specific embodiments thereof, it will be apparent to one skilled in the art that various changes and modifications can be made therein without departing from the spirit and scope thereof.

What is claimed is:

1. In a method of producing a composition for use in thermally developable light-sensitive photographic elements comprising mixing: (i) a composition comprising (a) an organic silver salt and (b) a light-sensitive silver halide and (ii) (c) a reducing agent which is present in an amount of from about 0.05 to about 10 mols per mol of said organic silver salt (a); the improvement wherein said composition comprising (a) and (b) is prepared by allowing a light-sensitive silver halide-yielding component present in an amount of from 0.001 to about 0.5 per mol of said organic silver salt (a) to react with said organic silver salt (a) in the presence of (d) an imino compound present in an amount of from about $1\times10^{-6}$ to about $6\times10^{-3}$ per mol of said organic silver salt (a) and being represented by the following general formula:

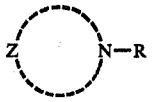

wherein R represents a hydrogen atom, a halogen atom a hydroxy group or a sulfonyl group; and Z represents the atoms necessary to complete a nucleus selected from the group consisting of pyrazoles, imidazoles, benzimidazoles, triazoles and benzotriazoles.

2. The method of claim 1, wherein component (a) is a silver salt of a fatty acid having 10 to 35 carbon atoms.

3. The method of claim 1, wherein said silver halide-yielding component is an N-halogeno compound represented by the general formula (I) or (II)

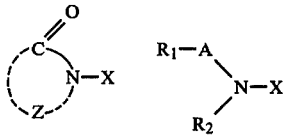

(I) (II)

wherein X represents Cl, Br or I, $Z_1$ represents the atomic group necessary to form a 5- to 7-membered ring which may be further condensed with another ring, A represents a carbonyl group and $R_1$ and $R_2$ each represent a hydrogen atom, an alkyl group, an aryl group or an alkoxyl group.

4. The method of claim 3, wherein an alcohol having 1 to 5 carbon atoms is additionally present.

5. The method of claim 1, wherein the method includes adding component (d) to component (a) from 10 to 60 minutes before the addition of the silver halide-yielding component.

6. The method of claim 1, wherein component (a) is used as a polymer dispersion.

7. The method of claim 6, wherein said polymer is selected from the group consisting of polyvinyl butyral, polyvinyl acetate, ethyl cellulose, polymethyl methacrylate, cellulose butyrate and polyvinyl alcohol, wherein the polymerization degree thereof is about 100 to about 1,500.

8. The method of claim 7, wherein the polymer is polyvinyl butyral.

9. A thermally developable light-sensitive element comprising the composition obtained by the method of claim 1.

10. The method of claim 1, wherein the nucleus completed by Z may be unsubstituted or substituted with one or more of an alkyl group which may be substituted with one or more of an alkoxy group, an acyl group, a halogen atom, a hydroxyl group, an amino group, a nitro group and a phenyl group; an alkoxy group; an acyl group; an alkylthio group; a hydroxyl group; a mercapto group; a halogen atom; a nitro group; a nitroso group; an amino group; and a sulfonyl group.

11. The method of claim 1, wherein said imino compound (d) is selected from the group consisting of benzotriazole, 5-methylbenzotriazole, 5-n-octylbenzotriazole, 5-(4-bromo-n-butyl)benzotriazole, 6-chlorobenzotriazole, 1-hydroxybenzotriazole, 5-n-octyloxybenzotriazole, 1-acetylbenzotriazole, 5,6-dimethylbenzotriazole, 6-nitrobenzotriazole, 1-acetyl-5-methylbenzotriazole, triazole, 4-methyltriazole, triacetyltriazole, 5-chlorotriazole, 4-ethyl-5-methyltriazole, benzimidazole, 2-hydroxybenzimidazole, 1-acetylbenzimidazole, 1-hydroxybenzimidazole, 2-n-propylthiobenzimidazole, 4-n-butylbenzimidazole, 4-(3-amino-n-propyl)-imidazole, 6-nitrobenzimidazole, imidazole, 2-methylimidazole, 2-hydroxyimidazole, 1-acetyl-2-hydroxyimidazole, 4-methylimidazole, 4-octyloxyimidazole, 4-methyl-2-hydroxyimidazole, 5-chloroimidazole, 5-methylpyrazole, 3-chloropyrazole, 3,5-dimethylpyrazole 1-(methanesulfonyl)benzotriazole, 1-(benezenesulfonyl)benzotriazole, 1-(p-methyl-benzenesulfonyl)benzotriazole and 1-(p-nitro-benzenesulfonyl)benzotriazole.

12. The method of claim 1, wherein said imino compound (d) is a benzimidazole.

* * * * *